United States Patent [19]

Hartig

[11] Patent Number: 4,672,928

[45] Date of Patent: Jun. 16, 1987

[54] IGNITION DEVICE FOR INTERNAL COMBUSTION ENGINES

[75] Inventor: Gunter Hartig, Karlsruhe, Fed. Rep. of Germany

[73] Assignee: Pierburg GmbH & Co KG, Neuss, Fed. Rep. of Germany

[21] Appl. No.: 673,525

[22] Filed: Nov. 20, 1984

[30] Foreign Application Priority Data

Nov. 25, 1983 [DE] Fed. Rep. of Germany ..... 3342723

[51] Int. Cl.[4] ..... F02P 3/06

[52] U.S. Cl. ..... 123/143 B; 123/169 E; 123/652; 123/620

[58] Field of Search ..... 123/143 B, 169 E, 620, 123/644, 652, 655, 656

[56] References Cited

U.S. PATENT DOCUMENTS

| | | | |
|---|---|---|---|
| 4,380,989 | 4/1983 | Takaki | 123/644 |
| 4,407,259 | 10/1983 | Abo | 123/620 |
| 4,557,229 | 12/1985 | Kashima et al. | 123/169 E X |

FOREIGN PATENT DOCUMENTS

| | | | |
|---|---|---|---|
| 2507286 | 8/1975 | Fed. Rep. of Germany . | |
| 2543125 | 4/1977 | Fed. Rep. of Germany . | |
| 0824456 | 2/1938 | France | 123/169 E |
| 0099121 | 7/1923 | Switzerland . | |

*Primary Examiner*—Willis R. Wolfe, Jr.
*Attorney, Agent, or Firm*—Weingarten, Schurgin, Gagnebin & Hayes

[57] ABSTRACT

The invention teaches an ignition device for internal combustion engines, comprising at least one spark gap with two ignition electrodes for generating ignition sparks between them, whereby neither of the two ignition electrodes is connected to the ground potential of the internal combustion engines; an ignition current source which is coupled to the ignition electrodes, insulated from ground, to generate the sparks, and forming an ignition circuit therewith; a voltage source, which has one pole at ground, while its other pole is connected to the ignition circuit, so that the ignition circuit is at the same potential as the voltage source and a separate plasma circuit is formed which comprises the voltage source, at least one of the two electrodes, a plasma composed of hot combustion gases between the ignition electrodes and ground, in a series circuit; and means in the plasma circuit which deliver an output pulse corresponding to the strength and time pattern of the current in the plasma circuit.

9 Claims, 10 Drawing Figures

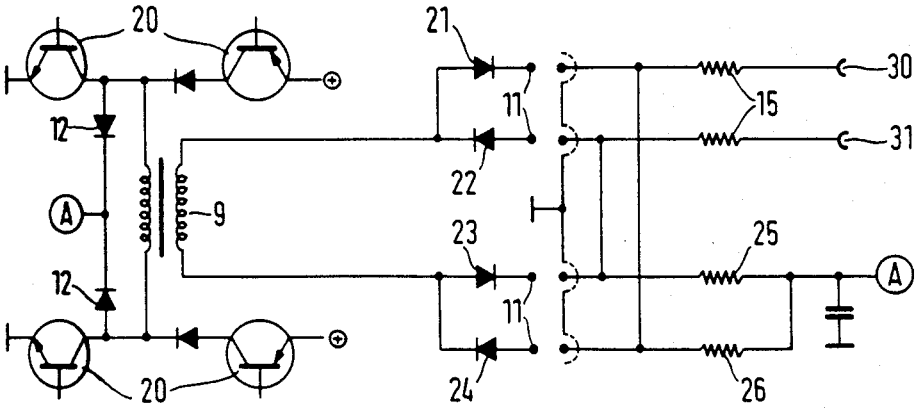
FIG. 6
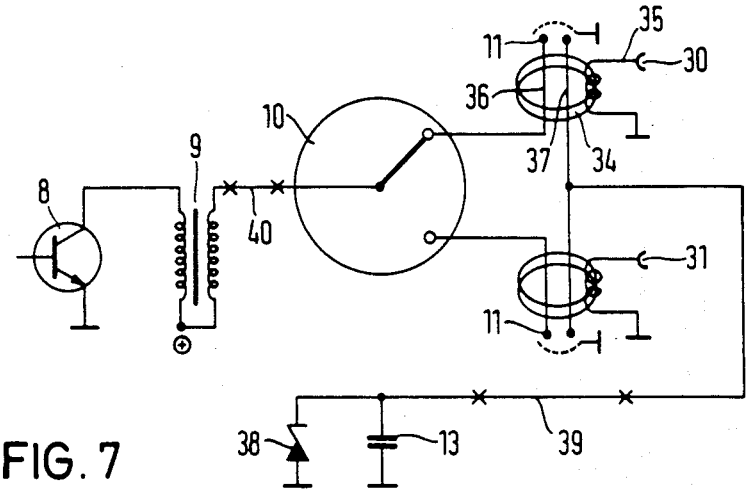
FIG. 7
FIG. 7a
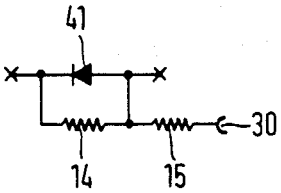

IGNITION DEVICE FOR INTERNAL COMBUSTION ENGINES

The invention relates to an ignition device for internal combustion engines with at least one ignition coil and a plurality of spark plugs for igniting the mixture, wherein none of the electrodes of the spark plugs is at the potential of the engine (ground potential), but it is at a voltage which is generally different from ground potential.

This "groundless" arrangement makes it possible to use electrodes as ionization probes relative to ground potential. The goal of the invention is to use this arrangement to determine, by measuring the ion current, when and whether the ignition is ignited, without significant changes to the engine. In addition, the ion current modulated by the pressure waves indicates when the engine is pinging.

Ignition systems and mixture preparation systems can be regulated by means of an output pulse obtained from the ion current in such fashion that predetermined combustion processes can be achieved.

This control capability is known, and is not the subject of the invention. It is described for example in German OS No. 24 43 413 (Bosch) and requires a separate ionization probe. Electronic ignition and injection systems are likewise known, which are controlled by engine parameters, and by means of which closed control circuits pertaining to combustion can be created, for example according to German Pat. No. 1,917,389.

In addition, spark plugs are known with ionization probes built into them, described in MTZ 39 (1978) 7/8, page 333, Haahtela.

German OS No. 25 07 286 teaches a method of detecting combustion problems in internal combustion engines, wherein a measuring voltage is connected parallel to the ignition current to the spark plug electrodes. Successful ignition causes an additional current to flow through the plasma created during combustion. This arrangement makes is possible to determine only whether the fuel-air mixture has been ignited, but not how well it burned. The location of the ion current measurement is identical to the spark gap where the ignition takes place, so that the ion current cannot be measured during ignition, but only when the spark has gone out.

By contrast to this arrangement, in the present invention a plasma current can also be measured during the burning of the spark. The output pulse is created when the ignited fuel-air mixture strikes the combustion chamber wall, i.e., when the diameter of the resultant fireball is about five millimeters.

German OS No. 25 43 125 teaches an ignition device for internal combustion engines wherein a spark gap with two insulated ignition electrodes is used. This provides for improved supply of the high-frequency voltage used in this arrangement for ignition. The ion currents are not measured.

Swiss Pat. No. 99 121 teaches an installation of a spark plug which is insulated from ground, but merely serves to ignite two spark gaps in the same combustion chamber in series using the existing ignition current source.

U.S. Pat. No. 4,407,259 teaches a plasma ignition system wherein a current source ignites the spark gaps and additional current sources supply the energy to create a plasma. Plasma currents are not measured and no output pulse is created as a function of the state of the plasma.

The known arrangements have in common the feature that both the ignition system and the ion current measurement are linked to the ground potential of the engine. As a result, either a separate ion current probe is required, which is not easy to install because of the shape of the combustion chamber and the position of the valves, for example in a Heron combustion chamber, or there are separate spark plugs with built-in ionization probes, which on the one hand involve problems in manufacture and on the other hand measure ionization too close to the point where ignition occurs.

The goal of the invention is particular is to create an ignition system of the type recited hereinabove with simultaneous provision for measuring an ion current, thereby avoiding the shortcomings of known designs.

This goal is achieved according to the invention by virtue of the fact that, for example, spark plugs of the conventional design are installed in an insulted fashion, whereby an insulating spacer with a thread and a support made of suitable material is used. This measure insulates the two ignition electrodes of the spark gap from the ground potential of the internal combustion engine. A voltage source supplies at least one of the electrodes with a voltage, so that an ion current flows between the ignition electrode and the wall of the combustion chamber as soon as the ignited mixture strikes the wall of the combustion chamber.

Specifically, the invention provides an ignition device for internal combustion engines consisting of the following:

(a) at least one spark gap with two electrodes to generate ignition sparks between them, whereby neither of the two electrodes is connected to the ground potential of the internal combustion engine;

(b) an ignition current source which is connected to the ignition electrodes insulated from ground to generate the ignition sparks and forms an ignition circuit therewith;

(c) a voltage source which has one pole at ground, while its other pole is connected to the ignition circuit, so that the ignition circuit is at the same potential as the voltage source and a separate plasma circuit is created which consists of the voltage source, at least one of the two electrodes, and a plasma made of hot combustion gases between the electrodes and ground, in a series circuit; and (d) means in the plasma circuit which deliver an output pulse corresponding to the strength and the time pattern of the current in the plasma circuit.

Preferably, this ignition system is so designed that the means for generating an output pulse is a resistor located in the plasma circuit to receive an output pulse which is created as a function of the current in the plasma circuit, whereby the ignition circuit is electrically insulated from the ground.

In addition, the ignition system according to the invention can be designed so that the current source is an ignition coil with an electrically insulated secondary winding.

A preferred embodiment of the ignition system according to the invention is characterized by the fact that the means for creating an output pulse is a transformer, which has two bifilar primary windings, through which the current flows to the electrodes, as well as a secondary winding to receive the output pulse.

If the ignition system according to the invention has at least two spark gaps in the ignition circuit, it can be designed so that one ignition electrode of one spark gap is connected directly with one electrode of the other spark gap, whereby the voltage source is located between the connecting point of these two electrodes and ground, and the other two electrodes are connected to the current source.

The latter ignition device is preferably designed so that a resistor is provided as a means of generating an output pulse, said resistor being connected between the connecting point and the voltage source, whereby the ignition circuit is electrically insulated from ground.

Finally, the ignition device according to the invention can be so designed that a mechanical distributor is located in the ignition circuit, said distributor, in accordance with the operating cycle of the internal combustion engine, connecting one of a plurality of spark gaps to the ignition circuit, each of said gaps comprising two electrodes insulated from ground.

Finally, in an ignition device wherein the current source is an ignition coil with an electrically insulated secondary winding, it is possible to provide four spark gaps each having two electrodes insulated from ground, and connected as follows:

(a) one terminal of the secondary winding is connected via a diode and an ignition electrode to each of two spark gaps, whereby the two diodes conduct in opposite directions;

(b) the other terminal of the secondary winding is likewise connected via another diode to each of the ignition electrodes of the other two gaps, whereby these two diodes likewise conduct in opposite directions;

(c) the other electrodes are connected together pairwise in such fashion that, depending on the polarity of the current source, current can flow through each pair of spark gaps; and (d) the connecting points of both pairs of electrodes are connected via at least one resistor as a means of generating output pulses to the voltage source. In a particular embodiment, these connecting points can each be connected through a resistor to the voltage source.

BRIEF DESCRIPTION OF THE DRAWING

FIG. 6 is a schematic diagram showing an embodiment of the present invention having an alternate energization of the ignition coils;

FIGS. 7 and 7*a* are schematic diagrams of an alternate embodiment including magnetic current sensing means;

Figure 1:
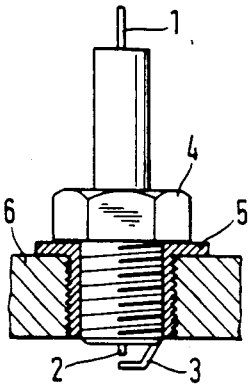
FIG. 1 is a drawing of a spark plug.

The invention is described below in greater detail with respect to preferred embodiments with reference to the figures in the drawings, wherein:

FIG. 1 shows the described installation of a known spark plug with ignition voltage terminal 1, central ignition electrode 2, ground electrode 3, threaded sleeve 4, and insulator 5; mechanical reasons, such as the fact that insulation of any sort ages as a result of the combustion pressures, make replacement of the insulation desirable each time the spark plug is replaced.

Figure 2:
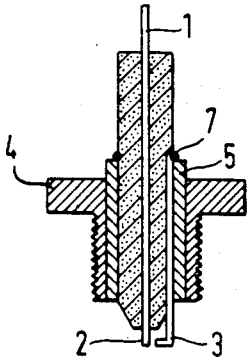
FIG. 2 is a cross section of a modified spark plug.

FIG. 2 shows a modified spark plug wherein insulator 5 is located between the former ground electrode 3 and threaded sleeve 4. In this design ground electrode 3 is brought out at the top, creating a coaxial connection via threaded sleeve 4, which can easily be contacted by an appropriately designed spark plug connector. The drawing has eliminated the design features necessary to ensure tightness, compression strength, insulation, and "free-blowing room", since these have been disclosed sufficiently often and are not the subject of this invention.

FIGS. 3 to 6 show the electrical part of several embodiments of arrangements according to the invention.

Figure 3:
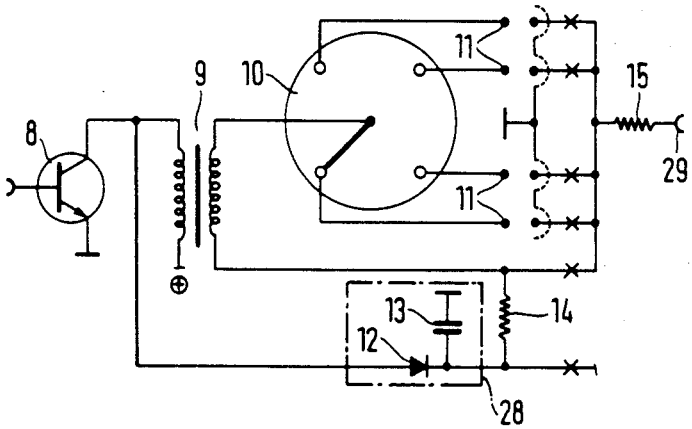
FIG. 3 is a schematic diagram showing one embodiment of the present invention used with a four-cylinder engine.

FIG. 3 refers to the control of a four-cylinder engine with mechanical distributor 10 and insulated electrodes 11. The primary "blow-back pulse" of transistor 8 in conjunction with ignition coil 9 charges capacitor 13 via diode 12, whereby a current source with a voltage of approximately 300 volts is created, supplying the ignition circuit (ion current probe) via resistor 14. Of course, the device according to the invention is not limited to this type of voltage generation, but all known D.C. and A.C. voltage sources can be used. Beyond protective resistor 15 an output pulse corresponding to the level of the ion current between the ignition circuit and ground appears, leading to an engine control system, not shown.

Figure 4:
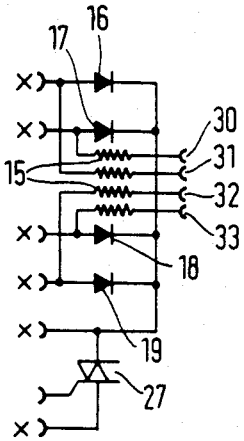
FIG. 4 is a partial schematic circuit diagram showing a modification to the schematic diagram of FIG. 3.

FIG. 4 describes the same system whereby, however, the individual spark plugs 11 are decoupled via diodes 16, 17, 18 and 19 and the individual ion current pulses are tapped off individually via protective resistors 15. Decoupling circuits using diodes and resistors are known and the details of the arrangement depend on the polarity of the existing voltages. Of course, individual spark plugs can also be assembled in groups, and common resistor 14 can also be split up, as shown in FIG. 6. The ion current pulse must be separated when, especially in multicylinder engines, ion current pulses overlap as a result of residual gas ionization, or when other devices are to be synchronized with the ion current pulse. As a result of the high ignition peak, noise pulses can appear as a result of capacitive asymmetries which are superimposed on the ion current pulses. This can be avoided by bridging series resistor 14 by a switching device during the ignition peak, causing the ignition circuit to have low resistance relative to ground. In the present example, a triac 27 is used for this purpose, controlled by the ignition control at the proper time. If it is only a question of suppressing voltage peaks, a capacitor can be used instead of the controlled switching device. This is not limited to this proposed circuit.

Figure 5:
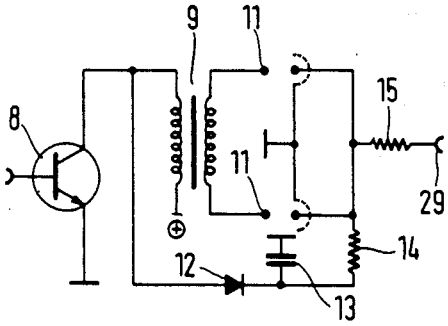
FIG. 5 is a schematic diagram of one embodiment of the invention for use with a two-cylinder engine.

FIG. 5 shows a design for a two-cylinder engine. Of course, it can also be used with suitable multiplication for four-, six-, eight-, and twelve-cylinder engines as well. If circuit 27 is eliminated in this example, an output pulse is obtained during the ignition peak whose polarity depends on which spark plug has the higher ignition voltage requirement.

FIG. 6 shows an arrangement with double usage of the ignition coil as described in German Pat. No. 23 39 784. Ignition coil 9 is remagnetized by a bridge circuit 20, consisting of two complementary switches with four transistors, whereby ignition pulses of different polarity are created and distributed by diodes 21, 24 and 22, 23 to two spark plug ignition circuits. The voltage is supplied via resistors 25 and 26 separately. Diode 12 is duplicated in order to take into account the characteristics of the bridge circuit. As in all previous circuit proposals, the ion current pulse is available at resistors 15 for evaluation.

FIG. 7 shows how the ion current pulse is tapped off through a transformer. This circuit is especially advantageous because it is feasible without changing the ignition system, including the distributor. The ion current is tapped off transformer-wise via a ring core 34 for example, through which the connections to the ignition electrodes pass and in the present example form two primary windings 36 and 37. An output pulse 30 is created at secondary winding 35 when the ion current flows. The second current source is a capacitor 13 which is charged by the spark current up to a voltage determined by zener diode 38. It should be mentioned at this point that a device 28 and an ignition coil 9 with an electrically insulated secondary winding as shown in FIG. 1 can be used as a second current source, so that the spark energy is not reduced.

It is obvious to an individual skilled in the art that instead of individual transformers 34, connected in series with each individual spark plug, a common transformer may be used with is connected to the corresponding spark plugs by distributor 10. The bifilar primary windings in this case are lines 39 and 40.

If we eliminate the possibility of measuring the plasma current during the burning time of the spark, transformers 34 become superfluous, since they are intended to compensate the ignition current.

However, a suitable design for switch arrangement 8 and ignition coil 9 must be provided such that the ignition spark is extinguished before the current begins to flow in the plasma circuit.

In this special case the output pulse can be generated very simply by a resistor 14, which, according to FIG. 7*a*, is added to line 39 in FIG. 7, and with which a diode 41 is connected in parallel. According to FIG. 4, instead of these individual diodes, a plurality of diodes 16, 17, 18 and 19 may be used, whereby the output pulses can be tapped off separately.

Figure 8:
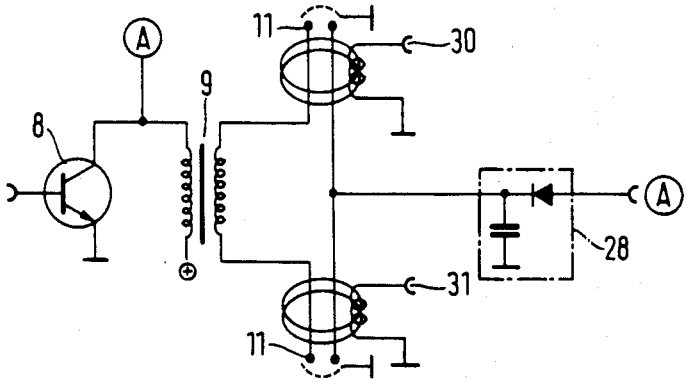
FIG. 8 is a schematic diagram showing an alternate embodiment of FIG. 5 including current sensing means.

FIG. 8 shows an arrangement corresponding to FIG. 5 wherein two spark gaps are connected in series, but the ion current is measured transformer-wise and tapped off. Relative to FIG. 6, the ion current can be measured transformer-wise in the same fashion, instead of via the voltage drop, at resistors 25 and 26 as described.

Figure 9:
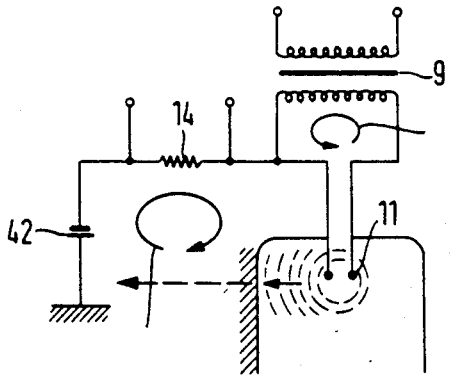
FIG. 9 is a partial schematic diagram demonstrating the general principal of the present invention applied to a one-cylinder engine.

FIG. 9 finally, shows once again the principle of the ignition device according to the invention in its simplest form in a one-cylinder engine.

The secondary winding of ignition coil 9 forms an ignition circuit with ignition electrodes 11 and, depending on the voltage in the secondary winding, an ignition spark is created between the electrodes which ignites the fuel-air mixture in the combustion chamber.

Initially a small fireball made of ionized plasma appears in the vicinity of the spark, said fireball increasing in diameter as combustion proceeds. When its diameter reaches a certain size, it comes in contact with the wall of the combustion chamber and a conducting link via the plasma is created between the combustion chamber wall and the ignition electrodes.

At this moment a current flows through the plasma since the plasma circuit composed of voltage source 42, ignition electrodes, and plasma is closed. An output pulse can be tapped off a resistor 14 which is also in the circuit, said pulse corresponding to the flow of current in the plasma circuit. The output pulse appears at the precise moment that a certain fraction of the mixture has actually been ignited. It is also possible for the plasma current to be modulated by pressure waves like those which occur in combustion accompanied by knocking. It is known that this modulation can be so evaluated in an electronic circuit that this undesirable knocking combustion can be avoided by adopting different mixture or ignition values for the engine.

I claim:

1. Ignition device for internal combustion engines comprising:

at least one spark gap with two ignition electrodes for creating ignition sparks between them in a combustion chamber of said internal combustion engine, neither of the two ignition electrodes being connected to ground potential of an internal combustion engine; and an ignition current source which is connected to the ignition electrodes, said ignition current source and said ignition electrodes forming an ignition circuit insulated from ground, with the current of said ignition circuit flowing within said combustion chamber between said two ignition electrodes and creating an ignition spark for inflaming an air-fuel mixture within said combustion chamber; and a plasma detection circuit for detecting the flame velocity of said inflamed air-fuel mixture by generating a current through the plasma of said inflamed air-fuel mixture, said current being generated externally of said spark gap, said plasma detection circuit comprises:

(a) a current path through said plasma extending between a wall of said combustion chamber and at least one of said ignition electrodes;

(b) a voltage source having one terminal coupled through ground to said wall of said combustion chamber, with the other terminal of said voltage source being coupled to said at least one ignition electrode; and (c) means for delivering an output pulse corresponding to the intensity and the time pattern of a current in said plasma detection circuit, wherein said output pulse occurs when said flame has travelled over the distance between said at least one ignition electrode and said wall of said combustion chamber.

2. Ignition device according to claim 1 characterized by the fact that the means for creating an output pulse is a transformer, which has two bifilar primary windings, through which the current flows to the ignition electrodes, and which also has a secondary winding to receive the output pulse.

3. Ignition device according to claim 1 characterized by the fact that a mechanical distributor is disposed in the ignition circuit, said distributor connecting one of a plurality of spark gaps into the ignition circuit depending on the operating cycle of the internal combustion engine, each of said spark gaps comprising two ignition electrodes insulated from ground.

4. The ignition device according to claim 1 wherein the means for creating an output pulse is a resistor connected in the plasma detection circuit to receive an output pulse that corresponds to the current in the plasma circuit.

5. The ignition device according to claim 4, wherein said resistor is connected between said voltage source and said at least one ignition electrode.

6. Ignition device according to claim 1 characterized by the fact that the current source is an ignition coil with an electrically insulated secondary winding.

7. Ignition device according to claim 6 characterized by the fact that four spark gaps, each having two ignition electrodes insulated from ground, are provided and connected as follows:

(a) one terminal of the secondary winding is connected via a diode and an ignition electrode to each of two spark gaps, whereby the two diodes conduct in opposite directions;

(b) the other terminal of the secondary winding is likewise connected via another diode and an ignition electrode to each of the other two spark gaps, whereby these two diodes conduct in opposite directions;

(c) the other ignition electrodes are connected together pairwise in such fashion that, depending on the polarity of the current source, a current can flow through each pair of spark gaps; and (d) the connecting points of both pairs of ignition electrodes are connected to the voltage source via at least one resistor as a means for creating the output pulses.

8. Ignition device according to claim 1 with two spark gaps in the ignition circuit, characterized by the fact that one ignition electrode of one spark gap is connected directly with an ignition electrode of the other spark gap, whereby the voltage source is located between the connecting points of these two electrodes and ground, and the other two electrodes are connected to the current source.

9. Ignition device according to claim 8 characterized by the fact that a resistor is provided as a means for creating an output pulse, said resistor being connected between the connecting point and voltage source, whereby the ignition circuit is electrically insulated from ground.

* * * * *